US006829531B2

(12) United States Patent
Lee

(10) Patent No.: US 6,829,531 B2
(45) Date of Patent: Dec. 7, 2004

(54) SYSTEM AND METHOD FOR PROVIDING CHANNEL INFORMATION OF ROADSIDE UNIT

(75) Inventor: Byoung Heon Lee, Gwangmycong-si (KR)

(73) Assignee: LG Electronics Inc., Seoul (KR)

( * ) Notice: Subject to any disclaimer, the term of this patent is extended or adjusted under 35 U.S.C. 154(b) by 108 days.

(21) Appl. No.: 10/227,271

(22) Filed: Aug. 26, 2002

(65) Prior Publication Data

US 2003/0045995 A1 Mar. 6, 2003

(30) Foreign Application Priority Data

Aug. 29, 2001 (KR) ..... 2001/52567

(51) Int. Cl.[7] ..... G08G 1/09

(52) U.S. Cl. ..... 701/205; 701/206; 701/223; 340/928; 340/935; 342/42; 455/500

(58) Field of Search ..... 701/200, 205, 701/206, 223; 340/928, 935, 933, 938; 342/42, 46; 455/41.2, 500

(56) References Cited

U.S. PATENT DOCUMENTS 5,424,727 A * 6/1995 Shieh ..... 340/928
5,771,484 A * 6/1998 Tognazzini ..... 701/117
6,285,858 B1 * 9/2001 Yoshida ..... 455/41.2

* cited by examiner

*Primary Examiner*—Thomas G. Black
*Assistant Examiner*—Arthur D. Donnelly
(74) *Attorney, Agent, or Firm*—Fleshner & Kim, LLP

(57) ABSTRACT

A channel search in an intelligent transportation system is disclosed. A roadside unit (RSU) currently communicating with an on-board unit (OBU) or a server connected to the RSU predicts a direction in which the OBU is moving, searches or recognizes an RSU managing the predicted OBU and channel information and/or service information of the RSU, and transmits the searched or recognized information to the OBU. Therefore, when the OBU enters a new communication zone, the OBU communicates with the corresponding RSU by applying the previously received channel information. As a result, the OBU is informed of the channels of the next RSU in advance, thereby reducing a channel search time and receiving a wanted service.

34 Claims, 5 Drawing Sheets

Fig. 4a
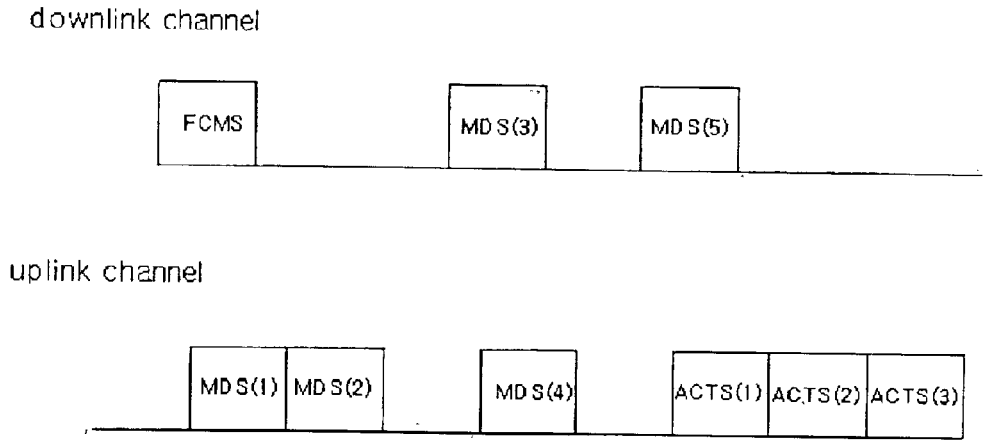
Fig. 4b
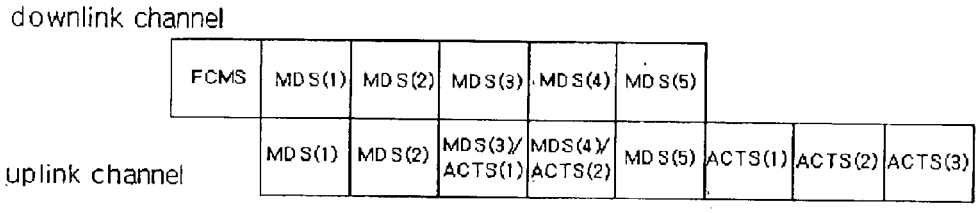
Fig. 4c
| Preamble | Sink | ID | Fcmc | Ack/ Nack | RSU information | map information | channel information | ..... |
|---|---|---|---|---|---|---|---|---|

SYSTEM AND METHOD FOR PROVIDING CHANNEL INFORMATION OF ROADSIDE UNIT

BACKGROUND OF THE INVENTION

1. Field of the Invention

The present invention relates to an intelligent transportation system (ITS), and more particularly to a system and method for providing channel information to search channels in an intelligent transportation system (ITS).

2. Background of the Related Art

An intelligent transportation system (ITS) serves radio communication between a roadside unit (RSU) installed by the roadside and an on-board unit (OBU) mounted on a vehicle by using dedicated short range communication (DSRC). The ITS constructs a system operated when a vehicle having the OBU passes a communication zone formed by antennas connected to the RSU, and provides various information and services to the vehicle upon request.

A variety of services are provided by the ITS according to frequency channels allocated to each RSU. Accordingly, when entering the communication zones of the RSU, the OBU searches a channel of the RSU by performing a channel search operation, and performs an initialization process to receive the information or other services.

FIG. 1 is a diagram illustrating the ITS to which the related art and the preferred embodiment of the present invention are both applied.

Referring to FIG. 1, the ITS includes an OBU 10 mounted on a vehicle for transmitting/receiving information through a DSRC, and first to fourth RSUs 21~24 installed by the roadside for performing radio data communication with the OBU 10. First and second local servers 31 and 32 are connected to the first to fourth RSUs 21~24 for analyzing traffic information and various data from the first to fourth RSU 21~24. Additionally, a traffic information providing server 40 is connected to the first and second local servers 31 and 32, and also to another communication network such as the Internet or a public switched telephone network (PSTN), for providing traffic information.

In the ITS, the OBU 10 transmits the collected traffic information to the first to fourth RSU 21~24. The first to fourth RSU 21~24 transmit the traffic information from the OBU 10 to the local server 31, and the local server 31 transmits the traffic information from the first to fourth RSU 21~24 to the traffic information providing server 40 connected to the local server 32 of a different area.

The traffic information providing server 40 analyzes the traffic information from the local servers 31 and 32, and transmits the traffic information to the OBU 10 through the local server and/or the first to fourth RSUs 21~24, thereby providing appropriate traffic information to a driver.

The traffic information transmitted from the RSU can be analyzed by the local server or the traffic information providing server.

In the ITS, the first to fourth RSUs 21~24 may respectively have a variety of functions or a special information providing function. In addition, the first to fourth RSUs 21~24 are provided with information providing channels for each function.

Although the first to fourth RSUs 21~24 use different channels with a special information providing function, the OBU 10 does not have information on the functions and channels of the first to fourth RSUs 21~24. Thus, the OBU 10 must monitor and search channels provided by the corresponding RSU 21~24 in every communication zone of the first to fourth RSUs 21~24.

FIG. 2 is a flowchart showing sequential steps of a related art method for providing channel information by an RSU.

First, a vehicle having an OBU 10 passes a zone occupied by an RSU (22 of FIG. 1) (S201). Then, the OBU 10 enters a communication zone of a new RSU 23 (S202). Here, the OBU 10 searches a channel of the RSU 23 and performs initialization (S203). The OBU 10 then searches channel information and/or service information on the new RSU 23 (S204), and communicates with the RSU 23 (S205).

In the related art channel search method for the OBU 10, when frame control message channel (FCMC) data, which is included in a frame control message slot (FCMS), is received in a frame structure from the RSU according to the information science technology (IST) specification of the telecommunications technology association (TTA), it is considered that the data is precisely received from a current channel. The FCMS is a slot containing basic information, such as frequency information by the channel.

Thus, when the OBU 10 enters one of the communication zones of the first to fourth RSUs 21~24, the OBU 10 waits for FCMC data. When the OBU 10 receives the FCMC data from the middle part, it must wait for a next FCMC data. That is, if it does not receive the full frame of data, it cannot use the partially received data. Waiting for the next FCMC data increases time consumption.

Thus, when the OBU 10 receives the FCMC data from the middle part (the frame transmission having begun before the OBU enters the zone), the OBU 10 cannot analyze the data. Accordingly, the OBU 10 must wait to receive the complete FCMC data to search the channel.

As a result, when the kinds of the ITS services and a number of allocated channels are increased, it takes quite a long time for the OBU to search channels of the RSU. Additionally, when the communication zone of the RSU is short and the vehicle is moving quickly, the OBU fails to search channels.

For example, when it is presumed that a time for searching one channel is, on average, 10 ms and there are eight channels, it takes about 80 to 90 ms to search all of the channels. If it is presumed that the communication zone is 10 M long and the vehicle is traveling at 100 Km/h, a time for passing the communication zone is about 360 ms. That is, the time for searching the channels reaches to ¼ of the time for passing the communication zone.

In the case of services where data are frequently transmitted/received between the RSU and the OBU, such as a tollgate system, the vehicle cannot receive a wanted service after channel search. Moreover, when the vehicle passes the communication zone without completely ending the communication, it may be regarded as an illegal one.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

It is another object of the present invention to provide to a system and method for providing channel information of a roadside unit (RSU) which can reduce a channel search time by transmitting channel information and/or service information of a next RSU from a current RSU to an on-board unit (OBU).

It is another object of the present invention to provide a method for providing channel information by an RSU from an RSU which can reduce communication errors and efficiently use a communication time by enabling a current RSU to transmit channel information of a next RSU to an OBU so that the OBU can be easily informed of channels of the next RSU without searching the channels.

To achieve at least the above objects in whole or in parts, there is provided a method for providing channel information by an RSU, including predicting a proceeding direction of an OBU by an RSU currently communicating with the OBU or a server connected to the RSU, searching or recognizing an RSU managing the predicted OBU and channel information and/or service information of the RSU, transmitting the searched or recognized information of the RSU to the OBU, and communicating between the OBU and the corresponding RSU using the transmitted information, when the OBU enters a corresponding communication zone.

To achieve at least the above objects in whole or in parts, there is further provided a method for providing channel information by an RSU, including searching a communication zone prior to a current communication zone, predicting a direction of movement an on-board unit (OBU) by using information of at least one of a RSU of the prior communication zone and an RSU of the current communication zone, and obtaining information of a next RSU which will manage the OBU.

To achieve at least the above objects in whole or in parts, there is further provided a method for providing channel information of a roadside unit (RSU), including predicting a direction of movement of an on-board unit (OBU) by at least one of a current RSU currently communicating with the OBU and a server connected to the current RSU, searching or recognizing a next RSU that is predicted to next manage the OBU and at least one of channel information and service information of the next RSU, transmitting the searched or recognized information of the next RSU from the current to the OBU, and communicating between the OBU and the next RSU using the transmitted information, when the OBU enters a corresponding communication zone.

To achieve at least the above objects in whole or in parts, there is further provided a system for providing channel information by an RSU including a first RSU covering a first communication zone, and configured to communicate with an on-board unit (OBU), the OBU being in transit from the first communication zone to a second communication zone, and a second RSU covering the second communication zone, and configured to communicate with the OBU when the OBU enters the second communication zone, wherein the first RSU and the second RSU are conterminous, wherein the first RSU provides information of the second RSU to the OBU while the OBU is in the first communication zone, and wherein the OBU uses the information of the second RSU to establish communication with the second RSU upon entering the second communication zone.

In accordance with the preferred embodiments of the present invention, the current RSU predicts the direction of travel of the vehicle having the OBU, and transmits channel information and/or service information of the next RSU to the OBU in advance. The channel search time is thus omitted and time consumption and channel search errors are reduced, thereby improving communication efficiency.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein:

FIGS. 4*a* and 4*b* are exemplary diagrams respectively illustrating TDMA/TDD and TDMA/FDD frame structures used in a DSRC system according to a preferred embodiment of the present invention;

FIG. 4*c* shows a message transmitted from the frame of FIGS. 4*a* and 4*b*.

DETAILED DESCRIPTION OF PREFERRED EMBODIMENTS

Figure 1:
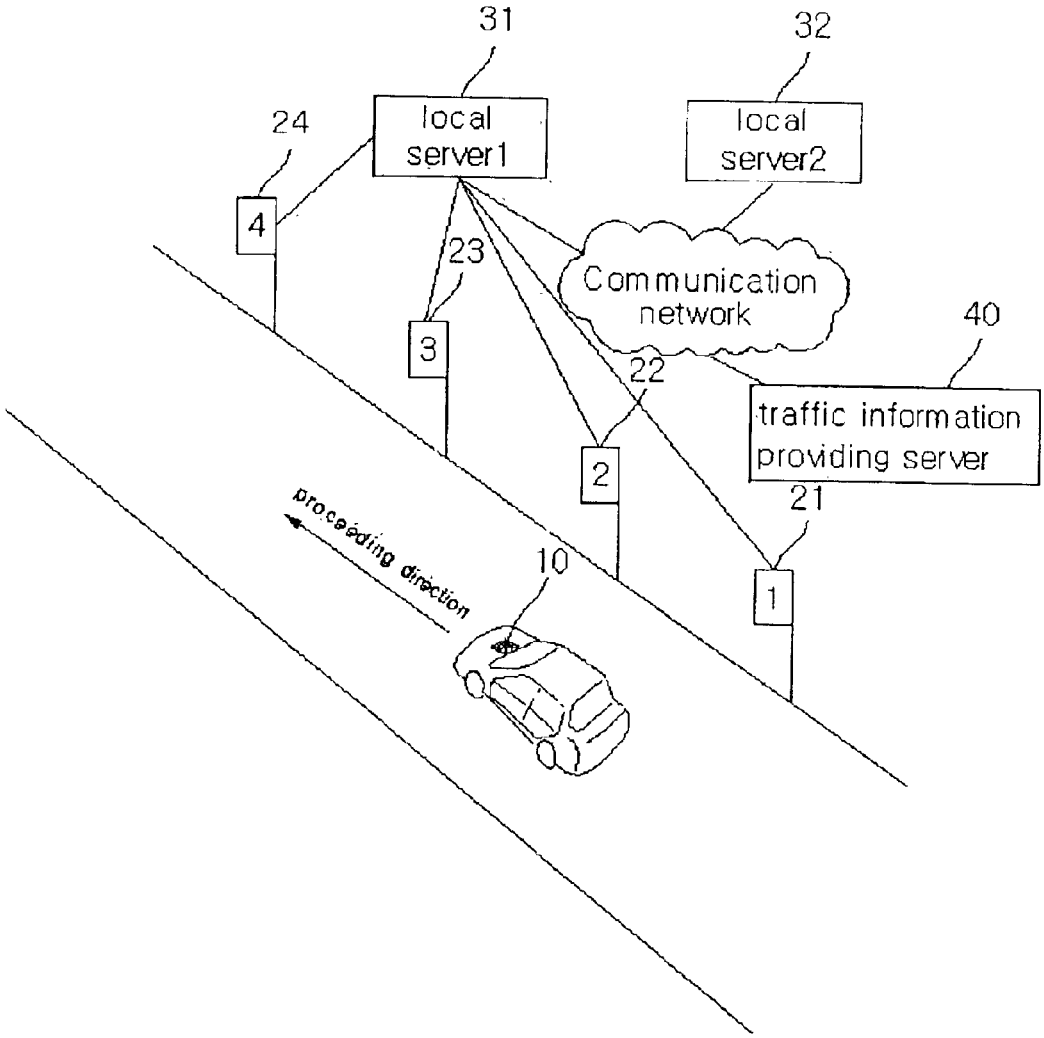
FIG. 1 is a diagram illustrating an ITS to which the related art and a preferred embodiment of the present invention are both applied.
Figure 2:
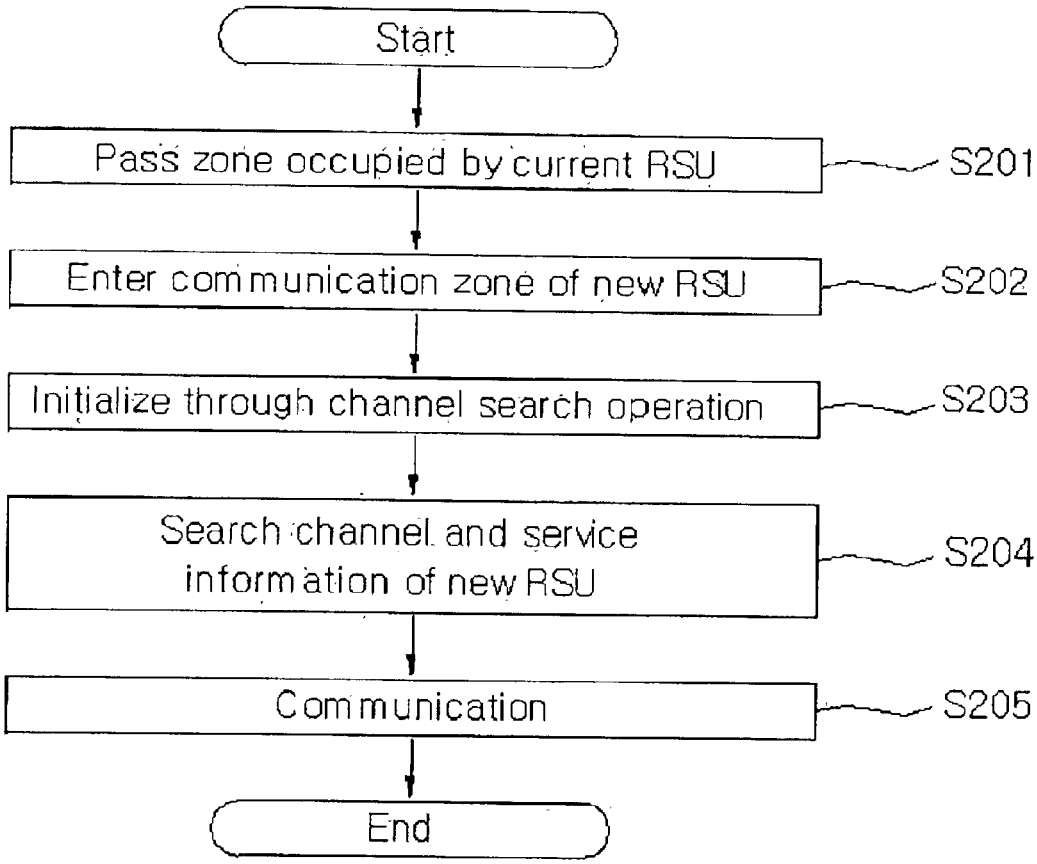
FIG. 2 is a flowchart showing sequential steps of a related art method for providing channel information by an RSU.

A preferred embodiment of the present invention will now be described with reference to the accompanying drawings. In the following description, same drawing reference numerals are used for the same elements even in different drawings. The matters defined in the description, such as a detailed construction and elements of a circuit, are exemplary and provided to assist in a comprehensive understanding of the invention. Thus, it will be apparent that the present invention can be carried out without those defined matters. Also, well-known functions or constructions are not described in detail since they would obscure the invention in unnecessary detail.

Figure 3:
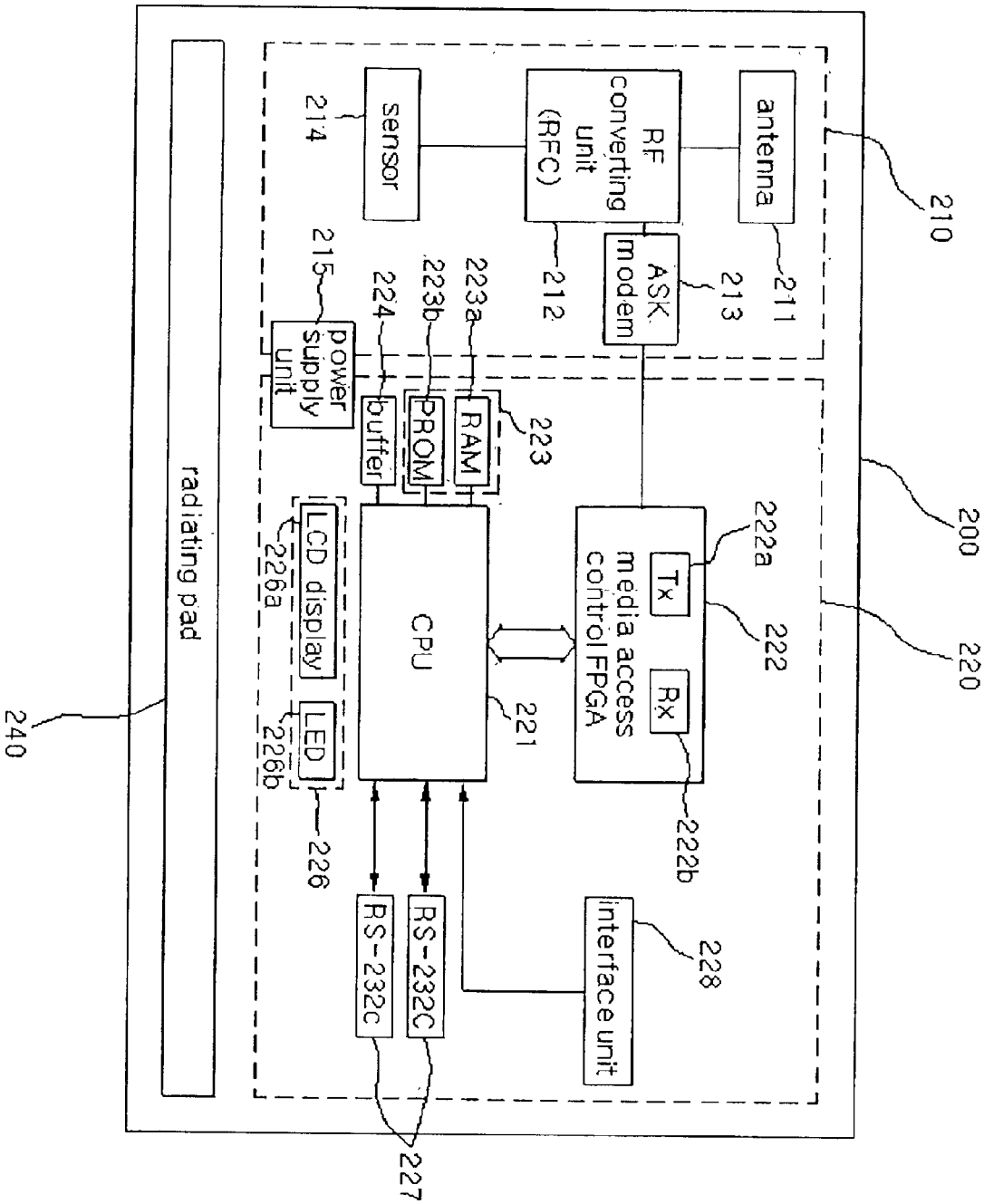
FIG. 3 is a diagram illustrating the RSU according to a preferred embodiment of the present invention.

FIG. 3 is a diagram illustrating an RSU (21 to 24 of FIG. 1) according to a preferred embodiment of the present invention. As illustrated in FIG. 3, the RSU includes a radio frequency unit 210 and a control unit 220 which are preferably incorporated into a single device.

The radio frequency unit 210 preferably includes an antenna 211 for emitting or receiving signals of a prescribed frequency, and a radio frequency converting unit 212 having an up converter for converting an amplitude sequence keying (ASK) modulated signal into a prescribed radio frequency signal, and a down converter for converting an ASK modulated signal into a demodulatable ASK signal. The radio frequency unit 210 further preferably includes an ASK modem 213, for ASK modulating a data signal and demodulating a received ASK signal, and a sensor 214, for sensing an operation state of the RSU.

The control unit 220 preferably includes a CPU 221 for performing processing operations, and a transmission (Tx) field-programmable gate array (FPGA) 222*a* for outputting the data from the CPU 221 to the ASK modem 213 by forming an appropriate communication frame by an active DSRC protocol. The control unit preferably further includes a media access control FPGA 222 having a reception (Rx) FPGA, 222*b* for extracting data required for the CPU 221 from the demodulated signal from the ASK modem 213. Next, a memory 223, having a RAM 223*a* and a PROM 223*b*, is preferably further included, as well as a buffer 224 for transmitting the signal sensed by the sensor 214 to the CPU 221. The control unit 220 preferably further includes a display unit 226 having an LCD display 226*a* for displaying a state and operation to the user, an LED 226*b* for displaying a state of the RSU to the user, an RS-232C 227 for performing serial communication with a PC or server, and an interface unit 228 for communicating with a long distance server.

While the RSU is transmitting radio data information, when a vehicle having an OBU 10 as a vehicle terminal enters within a prescribed range of the RSU, the RSU preferably sets up channels and exchanges information with the OBU 10 by using a TDMA/TDD or TDMA/FDD multiple access protocol. That is, when the vehicle having the OBU 10 enters a prescribed range, a frequency received through the antenna 211 of the radio frequency unit 210 is converted into a demodulatable ASK signal by the down converter of the radio frequency converting unit 212. The converted ASK signal is then preferably demodulated by the ASK modem 213. The demodulated signal is inputted directly to the media access control FPGA 222 of the control unit 220.

The media access control FPGA 222 receives the demodulated signal from the ASK modem 213 through the reception FPGA 222*b*. The reception FPGA 222*b* extracts data required for the CPU 221, and transmits the extracted data to the CPU 221.

The CPU 221 monitors the OBU 10 according to the received data and performs controlling operations. At this time, the CPU 221 preferably executes operations by using a program and parameter recorded in the RAM 223*a* and the PROM 223*b* of the memory 223, and transmits a result to a local server through the RS-232C 227 and the interface unit (Ethernet/ADSL/modem/PCS_Network) 228.

In the data transmission from the control unit 220 to the OBU 10, the CPU 221 preferably generates and outputs data, and the transmission FPGA 222*a* of the media access control FPGA 222 outputs the data by forming a communication frame suitable for an ITS active DSRC protocol.

The communication frame is inputted directly from the transmission FPGA 222*a* to the ASK modem 213 of the radio frequency unit 210. The ASK modem 213 ASK modulates the communication frame data, and transmits it to the radio frequency converting unit 212. The radio frequency converting unit 212 preferably converts the ASK modulated radio frequency signal into a prescribed radio frequency signal through the up converter, and transmits it to the OBU 10 through the antenna 211 as a signal having a prescribed transmission frequency.

The radio frequency unit 210 and the control unit 220 are preferably operated by power from a power supply unit 215. A radiating pad 240 may also be installed in a casing to efficiently radiate heat generated from the internal components through the lateral casing.

The radio frequency unit 210 transmits a signal to the OBU 10, and also communicates with the control unit 220 through a connector. Thus, the control unit 220 can communicate with the OBU 10, and a general RS422 for mutual communication is not necessary. In addition, a patch antenna using a printed circuit board may be employed as the antenna 211.

FIGS. 4*a* and 4*b* are diagrams respectively illustrating TDMA/TDD and TDMA/FDD frame structures used in a DSRC system according to the preferred embodiments. FIG. 4*c* shows a message transmitted from the frame of FIGS. 4*a* and 4*b*.

In the preferred embodiment, the RSU can simultaneously communicate with a maximum of eight OBUs through one frequency by using the TDMA/FDD or TDMA/TDD multiple access protocol. The TDMA method is a multiple access technique for dividing one frequency into a plurality of time slots, and allocating one channel to each time slot.

As shown in FIG. 4*a*, the TDD method performs bi-directional communication by enabling transmission and reception on a time axis by using one frequency. The FDD, on the other hand, determines a transmission channel and a reception channel through different frequencies, and employs a designated time slot, when the RSU (DSRC RSU) performs bi-directional communication with the OBU.

FIGS. 4*a* and 4*b* will now be described in more detail, referring primarily to FIG. 4*b*. As depicted in FIG. 4*b*, the TDMA/FDD frame structure includes a frame control message slot (FCMS), an activation slot (ACTS) and a message data slot (MDS). Here, communication information broadcasting, channel request, channel allocation, data transmission, and acknowledge (ACK) message transmission are performed by using the frame structure.

When the RSU broadcasts channel using information for a few OBUs by using the FCMS time slot, the OBU receiving the broadcast requests channel allocation to the RSU to receive a channel. The RSU selects a time slot which is a valid channel upon the request of the OBU, and notifies the OBU of the time slot. The OBU transmits data to the time slot designated by the RSU. Thereafter, reception of the data transmitted from the OBU to the RSU is acknowledged (ACK or NACK).

FIG. 4*b* shows the frame structure for an uplink or downlink channel of FIG. 4*a*.

FIG. 4*c* shows a message of each frame of FIG. 4*a* or 4*b*. A direction of travel of the vehicle having the OBU is predicted by using ID information of the message information of FIG. 4*c*. Channel information and service information of an RSU that the OBU is going to pass are then searched by using the other information.

Figure 5:
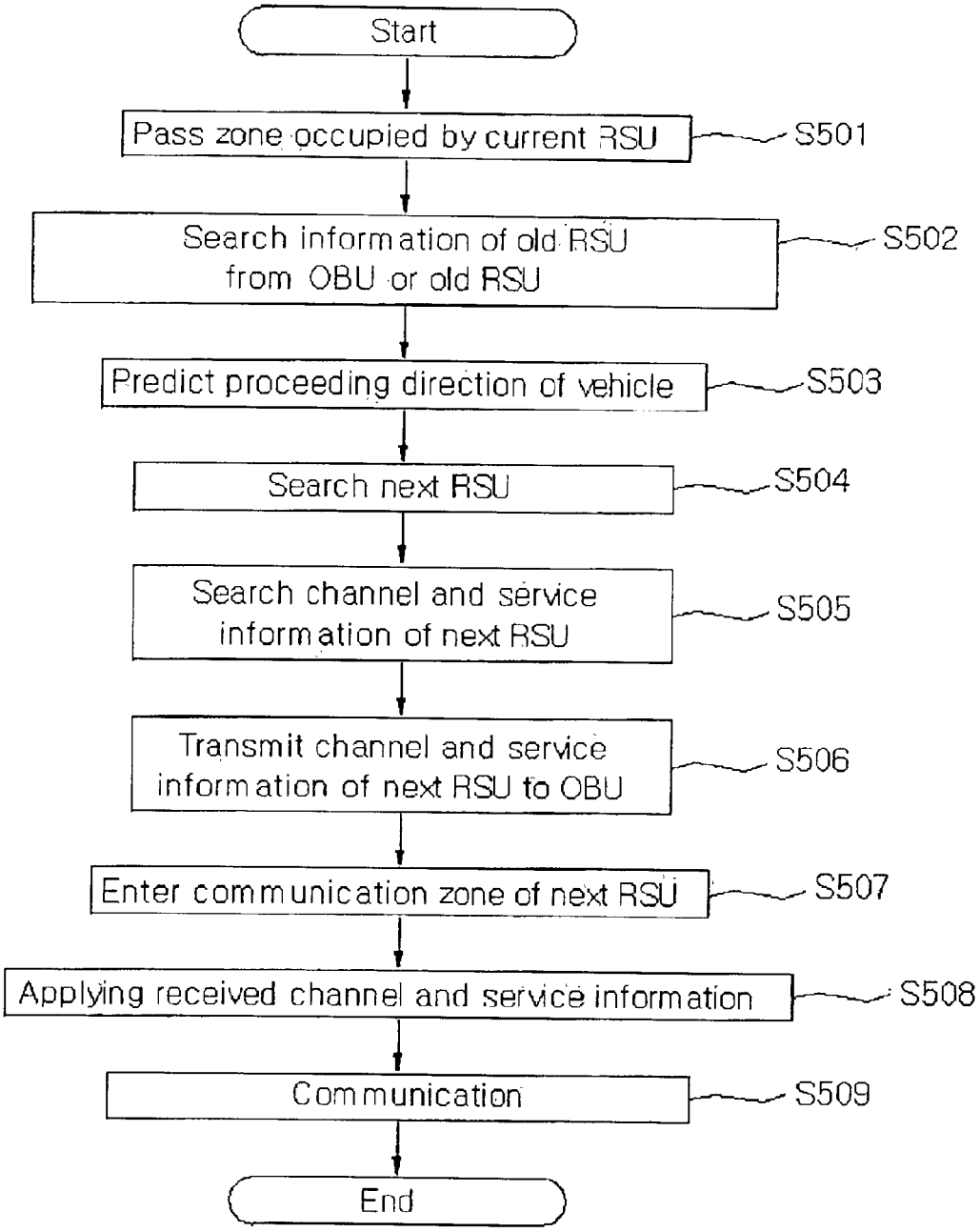
FIG. 5 is a flowchart showing sequential steps of a method for providing channel information by an RSU in accordance with a preferred embodiment of the present invention.

FIG. 5 is a flowchart showing sequential steps of the method for providing channel information by the RSU in accordance with the preferred embodiment of the present invention.

Referring to FIGS. 1 and 5, the OBU 10 first passes a zone occupied by the current RSU (22 of FIG. 1) (S501). In order to predict a next RSU, the current RSU 22 performing the DSRC with the OBU 10 searches information of an RSU 21 that the OBU 10 previously passed. This information is searched through the OBU 10, the previous RSU 21, or a local server/traffic information providing server connected to the previous RSU 21 (S502).

That is, the information of the previous RSU 21 can be transmitted from the OBU 10, which can maintain movement records, the previous RSU 21, or the local server/traffic information providing server connected to the previous RSU 21.

When the current RSU 22 receives the information from the OBU 10, searches the previous RSU 21, or receives the information from the local server/traffic information providing server connected to the previous RSU 21, the current RSU 22 predicts the direction of travel of the OBU 10 (S503), and searches a next RSU 23 (S504).

When the current RSU 22 is informed of the next RSU 23, the current RSU 22 searches channel information and/or service information of the next RSU 23, either through the current RSU 22 itself or the local server/traffic information providing server (S505). The searched information is then transmitted from the current RSU 22 to the OBU 10 (S506).

At this time, the current RSU 22 has the channel information and/or service information of the adjacent RSU 21, and 23, or requests the information of the RSU 23 to the local server 31/traffic information providing server 40.

The OBU 10 temporarily stores the channel information and/or service information of the next RSU 23. When the vehicle enters a communication zone of the next RSU 23 (S507), the OBU 10 applies the channel information and/or service information transmitted from the current RSU 22 (S508), and communicates with the next RSU 23 (S509). Thus, there is no need for the OBU 10 to search channel information for the next RSU 23.

The system and method for providing RSU information according to the preferred embodiment has many advantages. For example, the OBU is informed of the channel information and service information of the next RSU in advance. Accordingly, the OBU does not have to search channels in variations of the RSU. This reduces a channel search time and error ratio, and improves efficiency of communication with the RSU. Additionally, the OBU can immediately communicate with the next RSU when the OBU enters the communication zone of the next RSU.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A method for providing channel information of a roadside unit (RSU), comprising:

predicting a direction of travel of an on-board unit (OBU) by one of a current RSU communicating with the OBU and a server coupled to the current RSU;

transmitting to the OBU information of a next RSU that will communicate with the OBU; and communicating between the OBU and the next RSU using the transmitted information when the OBU enters a communication zone of the next RSU.

2. The method of claim 1, wherein the transmitted information comprises at least one of channel information of the next RSU and service information provided by the next RSU.

3. The method of claim 2, wherein the channel information is used by the OBU to establish communications with the next RSU.

4. The method of claim 2, wherein the at least one of channel information and service information of the next RSU are known by the current RSU or transmitted from a server for managing the current RSU and next RSU.

5. The method of claim 1, wherein the current RSU comprises at least one of channel information and service information of an adjacent RSU.

6. The method of claim 1, wherein information of a previous RSU is transmitted from at least one of the OBU, the previous RSU, and a server coupled to the previous RSU in order to predict the direction of travel of the OBU.

7. The method of claim 1, wherein the current RSU transmits the information of the next RSU to the OBU.

8. A method for providing channel information of a roadside unit (RSU), comprising:

searching a communication zone prior to a current communication zone;

predicting a direction of movement of an on-board unit (OBU) by using information of at least one of an RSU of the prior communication zone and an RSU of the current communication zone; and obtaining information of a next RSU which will manage the OBU.

9. The method of claim 8, wherein each communication zone comprises one RSU, and wherein the prior communication zone comprises at least one RSU prior to the current RSU.

10. The method of claim 8, wherein the information of the next RSU is transmitted to the OBU from the RSU of the current communication zone.

11. The method of claim 8, wherein the information of the RSU of the prior communication zone is transmitted from at least one of the OBU, the RSU of the prior communication zone, and a server coupled to the RSU of the prior communication zone, and wherein the information of the RSU of the prior communication zone is used to predict a direction of movement of the OBU.

12. The method of claim 11, wherein the direction of movement is used to predict the next RSU with which the OBU will communicate.

13. The method of claim 8, wherein the information comprises at least one of channel information of the next RSU and service information provided by the next RSU.

14. The method of claim 8, wherein the OBU uses the information of the next RSU to establish communication with the next RSU when the OBU enters a communication zone of the next RSU.

15. A method for providing channel information of a roadside unit (RSU), comprising:

predicting a direction of movement of an on-board unit (OBU) by at least one of a current RSU currently communicating with the OBU and a server coupled to the current RSU;

determining a next RSU that is predicted to next manage the OBU and searching at least one of channel information and service information of the next RSU;

transmitting the searched information of the next RSU from the current RSU to the OBU; and communicating between the OBU and the next RSU using the transmitted information when the OBU enters a communication zone of the next RSU.

16. The method of claim 15, wherein the information of a previous RSU is transmitted from at least one of the OBU, the previous RSU, and a server coupled to the previous RSU in order to predict a proceeding direction of a vehicle.

17. The method of claim 15, wherein the current RSU and the next RSU are conterminous.

18. The method of claim 15, wherein the OBU searches the at least one of channel information and service information of the next RSU through the current RSU.

19. A system for providing channel information of a roadside unit (RSU), comprising:

a first RSU covering a first communication zone, and configured to communicate with an on-board unit (OBU), the OBU being in transit from the first communication zone to a second communication zone; and a second RSU covering the second communication zone, and configured to communicate with the OBU when the OBU enters the second communication zone, wherein the first RSU provides information of the second RSU to the OBU while the OBU is in the first communication zone, and wherein the OBU uses the information of the second RSU to establish communication with the second RSU upon entering the second communication zone.

20. The system of claim 19, wherein the first RSU determines the direction of travel on the OBU using information provided from at least one of the OBU, a previous RSU covering a previous communication zone through which the OBU moved prior to entering the first communication zone, and a server coupled to the previous RSU.

21. The system of claim 20, wherein the first RSU uses the determined direction of travel to select which one of a plurality of next RSUs will be the second RSU.

22. The system of claim 19, wherein the information of the second RSU comprises at least one of channel information of the second RSU and service information provided by the second RSU.

23. The system of claim 19, wherein the first RSU and the second RSU are conterminous.

24. The system of claim 19, wherein the first and second RSU each comprises:

a radio frequency unit configured to transmit and receive information with the OBU and with other RSUs; and a control unit configured to process received information and generate information to be transmitted.

25. The system of claim 24, wherein the radio frequency unit comprises:

an antenna configured to emit or receive a signal containing information;

a radio frequency converting unit, configured to convert an amplitude sequence keying (ASK) modulated signal into a prescribed radio frequency signal, and to convert an ASK modulated signal into a demodulatable ASK signal;

an ASK modem, configured to ASK modulate a data signal, and demodulate a received ASK signal; and a sensor, configured to sense an operation state of the RSU.

26. The system of claim 24, wherein the control unit comprises:

a central processing unit (CPU) configured to process operations of the RSU and to monitor the OBU;

a transmission field-programmable gate array (FPGA) configured to output data from the CPU to the radio frequency unit by forming an appropriate communication frame by an active DSRC protocol; and a reception FPGA configured to receive and extract data required for the CPU from the radio frequency unit.

27. The system of claim 26, wherein the control unit further comprises:

a display unit having an LCD display to display a state and operation to a user, and an LED to display a state of the RSU to the user;

an RS-232C configured to perform serial communication with a PC or server; and an interface unit configured to communicate with a long distance server.

28. The method of claim 1, wherein the on-board unit is located on a moving vehicle.

29. The method of claim 1, wherein the information transmitted to the next RSU relates to an allocated time slot for communication at least between the OBU and the next RSU.

30. The method of claim 1, wherein the information transmitted to the next RSU relates to a frequency for communication at least between the OBU and the next RSU.

31. The method of claim 1, wherein the transmitted information relates to a methodology of communicating between the next RSU and the OBU.

32. The method of claim 8, wherein the obtained information relates to a methodology of communicating between the next RSU and the OBU.

33. The method of claim 15, wherein the transmitted information relates to a methodology of communicating between the next RSU and the OBU.

34. The method of claim 19, wherein the information relates to a methodology of communicating between the second RSU and the OBU.

* * * * *